US009324529B2

(12) United States Patent
Zhou et al.

(10) Patent No.: US 9,324,529 B2
(45) Date of Patent: Apr. 26, 2016

(54) CURRENT DIRECTION SENSITIVE CIRCUIT INTERRUPTER

(71) Applicant: EATON CORPORATION, Cleveland, OH (US)

(72) Inventors: Xin Zhou, Franklin Park, PA (US); Charles J. Luebke, Hartland, WI (US); Peter Theisen, West Bend, WI (US); Mark Allan Juds, New Berlin, WI (US)

(73) Assignee: EATON CORPORATION, Cleveland, OH (US)

( * ) Notice: Subject to any disclaimer, the term of this patent is extended or adjusted under 35 U.S.C. 154(b) by 87 days.

(21) Appl. No.: 14/251,757

(22) Filed: Apr. 14, 2014

(65) Prior Publication Data

US 2015/0294825 A1 Oct. 15, 2015

(51) Int. Cl.

*H01H 9/20* (2006.01)
*H01H 73/36* (2006.01)
*H01H 77/00* (2006.01)

(52) U.S. Cl.

CPC ..... *H01H 73/36* (2013.01); *H01H 77/00* (2013.01)

(58) Field of Classification Search

CPC ..... H01H 71/32–71/322; H01H 33/6662
USPC ..... 335/16, 21, 41, 170, 147
See application file for complete search history.

(56) References Cited

U.S. PATENT DOCUMENTS 2,321,603 A * 6/1943 Jensen ..... H01H 71/2463 200/296
3,381,181 A * 4/1968 Leland ..... H01F 7/1615 335/230
3,693,122 A * 9/1972 Willard ..... H01H 71/322 335/174
3,886,507 A * 5/1975 Johnston ..... H01H 51/2209 335/170
4,215,328 A * 7/1980 Chabot ..... H01H 71/1009 335/170
5,387,892 A * 2/1995 Rossetti ..... H01H 71/322 29/607
5,805,038 A 9/1998 Palmer et al.
6,838,961 B2 1/2005 Lias et al.
7,595,710 B2 * 9/2009 DeBoer ..... H01H 51/2209 335/14
8,013,698 B2 * 9/2011 Bonjean ..... H01F 7/1615 335/220
8,218,274 B2 7/2012 Hastings et al.
8,508,896 B2 8/2013 Paoletti et al.
8,542,083 B2 9/2013 Maloney
2002/0093408 A1 * 7/2002 Morita ..... H01F 7/1615 335/220
2011/0301772 A1 12/2011 Zuercher et al.
2014/0062623 A1 * 3/2014 Fasano ..... H01H 71/2463 335/16

* cited by examiner

*Primary Examiner* — Alexander Talpalatski
(74) *Attorney, Agent, or Firm* — Eckert Seamans Cherin & Mellott, LLC; Philip E. Levy; Nathaniel C. Wilks

(57) ABSTRACT

A circuit interrupter includes a first terminal, a second terminal, separable contacts moveable between a closed position and an open position, an operating mechanism configured to open said separable contacts, an electromagnetic element electrically connected between the first terminal and the second terminal and cooperating with said operating mechanism, and a diode electrically connected between the first terminal and the second terminal and in parallel with the electromagnetic element. When a current flowing through the circuit interrupter flows in a first direction from the first terminal toward the second terminal, the current flows through the diode. When the current flowing through the circuit interrupter flows in a second direction from the second terminal toward the first terminal, the current flows through the electromagnetic element.

11 Claims, 8 Drawing Sheets

CURRENT DIRECTION SENSITIVE CIRCUIT INTERRUPTER

BACKGROUND

1. Field

The disclosed concept relates generally to circuit interrupters, and more particularly, to circuit interrupters sensitive to current direction.

2. Background Information

Existing photovoltaic (PV) systems employ direct current (DC) fuses and circuit breakers in combiners, re-combiners and inverters to provide over-current protection. However, current DC fuses and circuit breakers do not provide effective protection for PV systems. PV systems have relatively low forward short circuit current levels and potentially high back-feed reverse short-circuit current levels. Both DC fuses and circuit breakers depend on thermal trips to activate the DC fuses or to trip the circuit breakers. Even though these circuit breakers also have magnetic trip, they usually will be activated only at relatively high fault current levels such as 5 times the rated current or higher. The traditional thermal-magnetic trips in a PV system have some disadvantages. One disadvantage is that it can take hours for a thermal trip to activate a DC fuse or cause a circuit breaker to trip. Another disadvantage is that a thermal trip is not sensitive to the direction of the current flowing through the DC fuse or circuit breaker. A relatively low level forward short circuit current in a PV system does not threaten the wiring of the PV system and this condition does not necessarily warrant interrupting the circuit. However, a trip should be quickly initiated for a relatively low level reverse back-feed current in a PV system. Therefore, it would be desirable to provide current direction sensitive circuit protection in PV systems.

Some existing circuit breakers are sensitive to the direction of the current flowing through the protected circuit. However, such circuit breakers generally require additional electronics such as a current sensor or an electronic trip unit which increases the cost of the circuit breaker. It would be desirable to provide current direction sensitivity in a circuit breaker without the need for additional electronics.

There is room for improvement in circuit interrupters.

There is also room for improvement in PV systems employing circuit interrupters.

SUMMARY

These needs and others are met by aspects of the disclosed concept which provide a circuit interrupter sensitive to the direction of current flowing through it.

In accordance with one aspect of the disclosed concept, a circuit interrupter includes a first terminal; a second terminal; separable contacts moveable between a closed position and an open position; an operating mechanism configured to open the separable contacts; an electromagnetic element electrically connected between the first terminal and the second terminal and cooperating with the operating mechanism; and a diode electrically connected between the first terminal and the second terminal and in parallel with the electromagnetic element; wherein when a current flowing through the circuit interrupter flows in a first direction from the first terminal toward the second terminal, the current flows through the diode; and wherein when the current flowing through the circuit interrupter flows in a second direction from the second terminal toward the first terminal, the current flows through the electromagnetic element.

In accordance with another aspect of the disclosed concept, A circuit interrupter includes a first terminal; a second terminal; separable contacts moveable between a closed position and an open position; an operating mechanism configured to open the separable contacts; an electromagnetic assembly cooperating with the operating mechanism, the electromagnetic assembly comprising: an armature coupled with the operating mechanism, the armature being movable between a first position and a second position that causes the operating mechanism to trip open the separable contacts; a coil electrically connected between the first terminal and the second terminal cooperating with the armature to move the armature between the first position and the second position based on a current flowing through the coil; a magnet; a platform disposed between the magnet and the armature; a spring structured to bias the armature toward the first position; and a housing surrounding the coil, the magnet, the platform, and a portion of the armature, the housing including an opening structured to allow the armature to pass through it, wherein a current flowing through the circuit interrupter flows in a direction from the first terminal toward the second terminal, the current flows in a first direction through the coil and causes the armature to move to or maintain the first position; and wherein when the current flowing through the circuit interrupter flows in a direction from the second terminal toward the first terminal, the current flows in a second direction through the coil and causes the armature to move to or maintain the second position.

In accordance with another aspect of the disclosed concept, a circuit interrupter includes a first terminal; a second terminal; separable contacts moveable between a closed position and an open position; an operating mechanism configured to open the separable contacts, the operating mechanism having a releasable cradle; a trip mechanism cooperating with the operating mechanism to open the separable contacts, the trip mechanism having an armature structured to support one end of the releasable cradle, a magnet disposed on the armature, and a conductor electrically connected between the first terminal and the second terminal, wherein the releasable cradle is structured to latch to the armature; wherein releasing the releasable cradle causes the operating mechanism to trip open the separable contacts; wherein when a current flowing through the conductor flows in a first direction toward the second terminal, it induces a magnetic field that repels the magnet away from the conductor and causes the releasable cradle to remain latched to the armature; and wherein when the current flowing through the conductor flows in a second direction toward the first terminal, it induces a magnetic field that attracts the magnet toward the conductor and causes the armature to move away from the releasable cradle and release from the armature.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
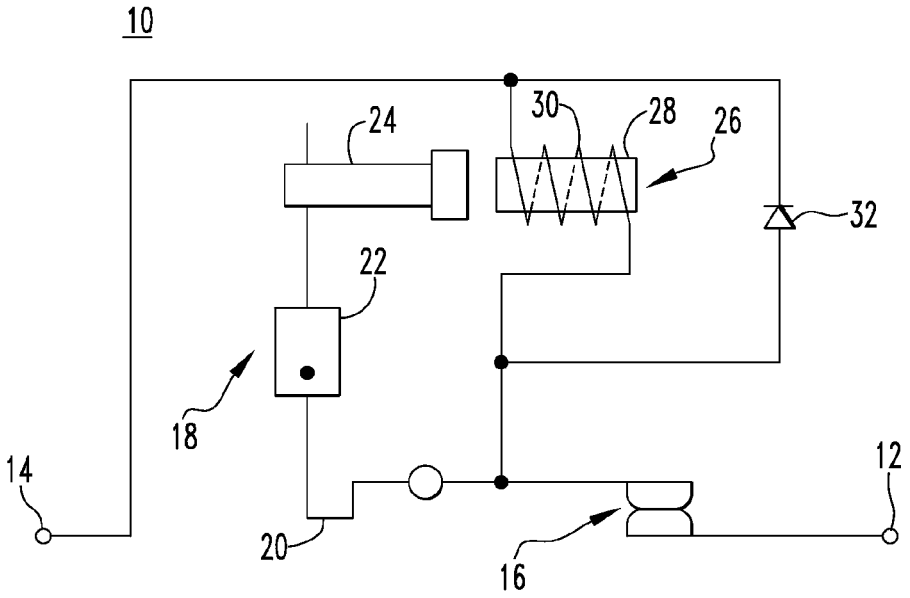
FIG. 1 is a circuit diagram of a circuit interrupter including a diode in accordance with an example embodiment of the disclosed concept.

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

As employed herein, the term "string" shall mean a series electrical circuit connection of a plurality of electrical generating modules.

As employed herein, the term "direct current electrical generating module" (DC EGM) shall mean a photovoltaic (PV) electrical generating module, a battery or a fuel cell.

Referring to FIG. 1, a circuit interrupter 10 in accordance with an example embodiment of the disclosed concept includes first and second terminals 12,14, separable contacts 16, an operating mechanism 18, an electromagnetic element 26, and a diode 32.

Figure 2:
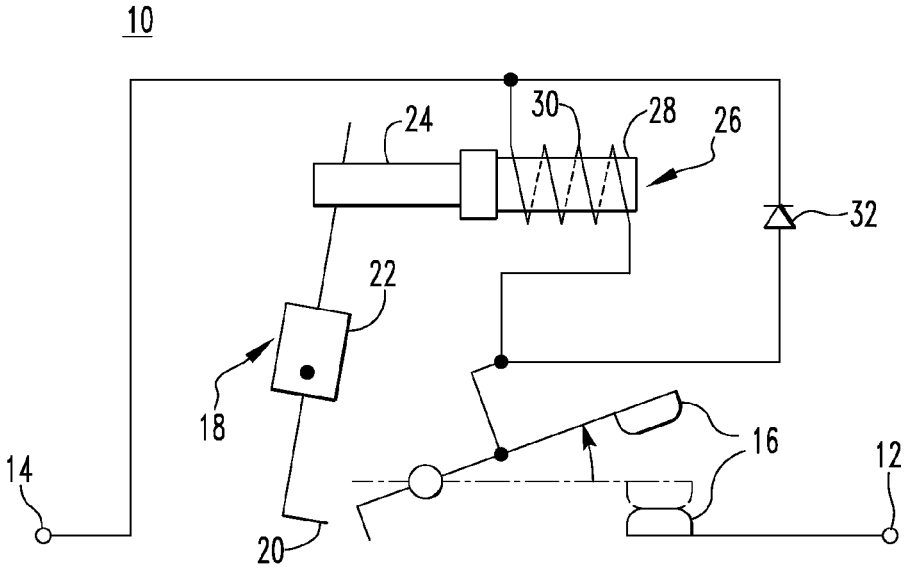
FIG. 2 is a circuit diagram of the circuit interrupter of FIG. 1 with tripped open separable contacts.

The operating mechanism 18 is structured to open and close the separable contacts 16. The operating mechanism 18 includes a latch 20 that is released by movement of a trip bar 22. In FIG. 1, the latch 20 has not been released and the separable contacts 16 are in contact with each other. Referring to FIG. 2, the latch 20 has been released by moving the trip bar 22 which in turn allows the separable contacts 16 to separate from each other. A linkage or spring (not shown) is used to cause the contacts to separate. Separating the separable contacts 16 interrupts the circuit between the first and second terminals 12,14. The operating mechanism 18 also includes an actuator 24 coupled to the trip bar 22. Movement of the actuator 24 causes the trip bar 22 to move as well, which in turn causes the latch 20 to release and the separable contacts 16 to separate.

The electromagnetic element 26 is structured to cooperate with the operating mechanism 18 to open the separable contacts 16. When a predetermined level of current passes through the electromagnetic element 26, a magnetic field is induced which pulls the actuator 24 toward the electromagnetic element 26. This movement of the actuator 24 move the trip bar 22 causing the latch 20 to release and the separable contacts 16 to separate. The electromagnetic element 26 includes a magnetic core 28 such as, without limitation, a ferro-magnetic material, with a coil 30 wrapped around it. Passing a current through the coil 30 induces a magnetic field that pulls the actuator 24 toward the magnetic core 28.

The diode 32 is electrically connected in parallel with the electromagnetic element 26. There are two current paths between the first terminal 12 and the second terminal 14. The first current path passes through the diode 32 and the second current path passes through the electromagnetic element 26. The diode 32 is oriented such that when current is flowing through the circuit interrupter 10 in a direction from the first terminal 12 to the second terminal 14, the diode 32 provides a low impedance path for the current to pass through it on the first current path. When the current is flowing in a direction from the second terminal 14 to the first terminal 12, the diode 32 blocks the current flowing through the circuit interrupter 10 from flowing through the diode 32 on the first current path. Rather, the current must instead flow through the electromagnetic element 26 on the second current path.

When a predetermined level of current flows through the electromagnetic element 26, the electromagnetic element 26 will cooperate with the operating mechanism 18 to cause the separable contacts 16 to separate. The circuit interrupter 10 is sensitive to the direction of the current flowing through it. That is, a current flowing in the direction from the first terminal 12 to the second terminal 14 will flow through the lower impedance diode 32 rather than the electromagnetic element 26 which has some coil resistance, and thus will not cause to the separable contacts 16 to separate. However, when the current flows in the direction from the second terminal 14 to the first terminal 12, the current flows through the electromagnetic element 26, which will cause the separable contacts 16 to separate if the current exceeds a predetermined level of current. Once the contacts open and the current is interrupted, the contacts will remain open due to a spring or linkage (not shown) even without current continuing to flow through the electromagnetic element.

The circuit interrupter 10 may be manually reset by pulling the actuator 24 away from the magnetic core 28. The latch 20 and separable contacts 16 are designed to return to the closed and latched condition via a spring or linkage (not shown). Pulling of actuator 24 may be done through a trip free mechanism (not shown) to allow for the circuit interrupter 10 to reopen if a reverse current is still present when the device is reset.

Figure 3:
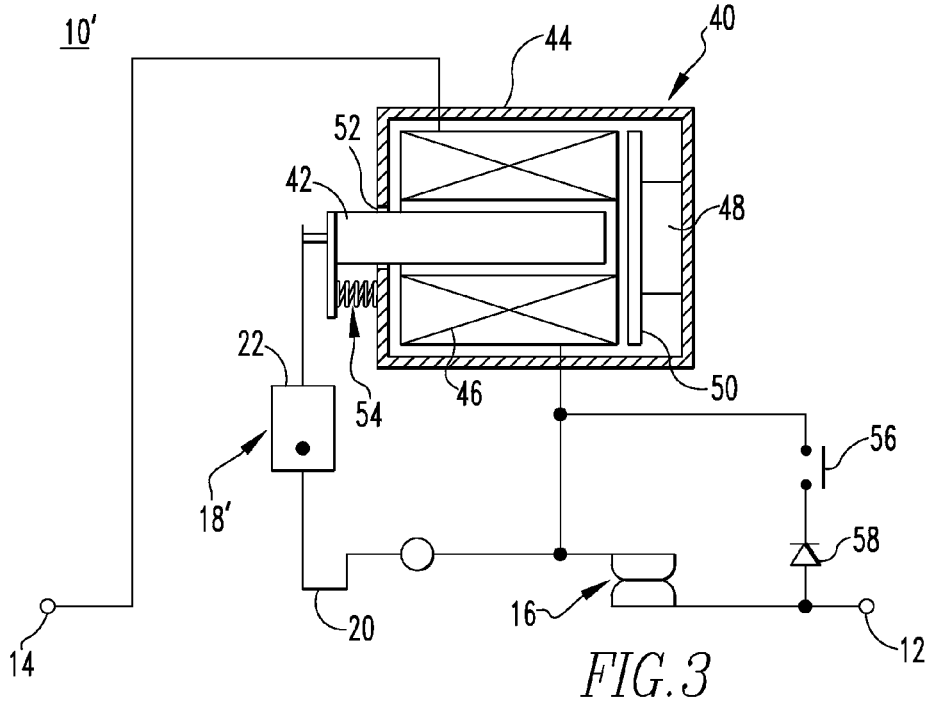
FIG. 3 is a circuit diagram of a circuit interrupter including an electromagnetic assembly in accordance with another example embodiment of the disclosed concept.

In FIG. 3, a circuit interrupter in accordance with another example embodiment of the disclosed concept includes first and second terminals 12,14, separable contacts 16, an operating mechanism 18', and an electromagnetic assembly 40.

Figure 4:
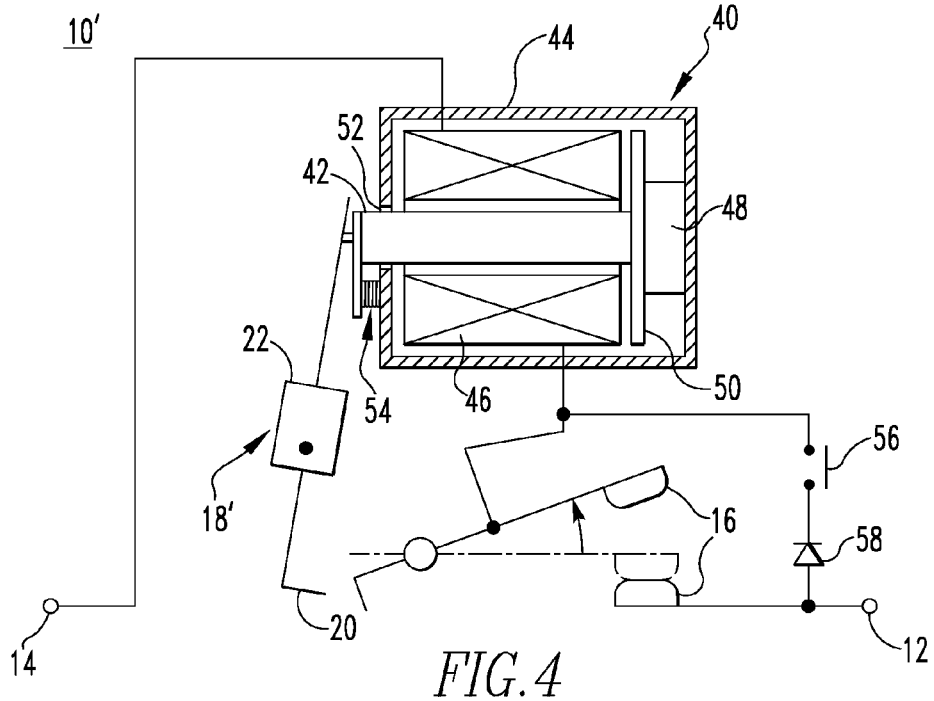
FIG. 4 is a circuit diagram of the circuit interrupter of FIG. 3 with tripped open separable contacts.

The operating mechanism 18' is structured to open and close the separable contacts 16 in a similar manner to the operating mechanism 18 of FIG. 1. In particular, the operating mechanism 18' of FIG. 3 includes a latch 20 that is released by movement of a trip bar 22. In FIG. 3, the latch 20 has not been released and the separable contacts 16 are in contact with each other. Referring to FIG. 4, the latch 20 has been released by moving the trip bar 22 which in turn allows the separable contacts 16 to separate from each other. Separating the separable contacts 16 interrupts the circuit between the first and second terminals 12,14. The trip bar 22 is coupled to an armature 42 included in the electromagnetic assembly 40.

Movement of the armature 42 causes the trip bar 22 to move, which in turn causes the latch 20 to release and the separable contacts 16 to separate.

The electromagnetic assembly 40 includes a housing 44 surrounding a coil 46, a permanent magnet 48, and a platform 50. The electromagnetic assembly 40 also includes the previously mentioned armature 42. The housing 44 includes an opening 52 which allows the armature 42 to extend partially outside the housing 44. A spring 54 biases the armature 42 away from the permanent magnet 48. The armature 42 is movable between a first position where it is separated from the platform 50, as shown in FIG. 3, and a second position where it contacts the platform 50, as shown in FIG. 4. In the example embodiment shown in FIGS. 3 and 4, the separable contacts 16 are in electrical contact with each other when the armature 42 is in the first position and are separated from each other when the armature 42 is in the second position. In other words, moving the armature 42 from the first position to the second position will cause the separable contacts 16 to trip open. However, it will be appreciated by those having ordinary skill in the art that the circuit interrupter 10' can be modified such that the first position of the armature 42 corresponds to a condition where the separable contacts are separated from each other and the second position of the armature 42 corresponds to a condition where the separable contacts 16 are in electrical contact with each other. Coil magnetic flux $\Phi_C$ (i.e., magnetic flux caused by the coil 46) and permanent magnet magnetic flux $\Phi_M$ (i.e., magnetic flux caused by the permanent magnet 48), as well as the bias caused by the spring 54, apply force to the armature 42 to move it between the first and second positions, as will be described in more detail herein with respect to FIGS. 5-8.

The circuit interrupter 10' can be manually or electrically reset. It can be manually reset as previously described with respect to FIGS. 1 and 2. An electrical reset can be achieved via a reset switch 56. The reset switch 56 can be located locally or remotely from the circuit interrupter 10'. A diode 58 is used to provide a trip free function by allowing only forward current to reset the device (i.e., closing of the rest switch 56 while reverse current is still present will not cause the circuit interrupter 10' to reclose onto a reverse current fault). The forward current in this case must be large enough to create sufficient flux and force to reset the device. A separate power source (e.g., without limitation; power from a PV array and/or a second coil) could be used to assure the ability to reset the circuit interrupter 10' under low forward current conditions (e.g., without limitation; a low illumination condition in a PV system).

Figure 5:
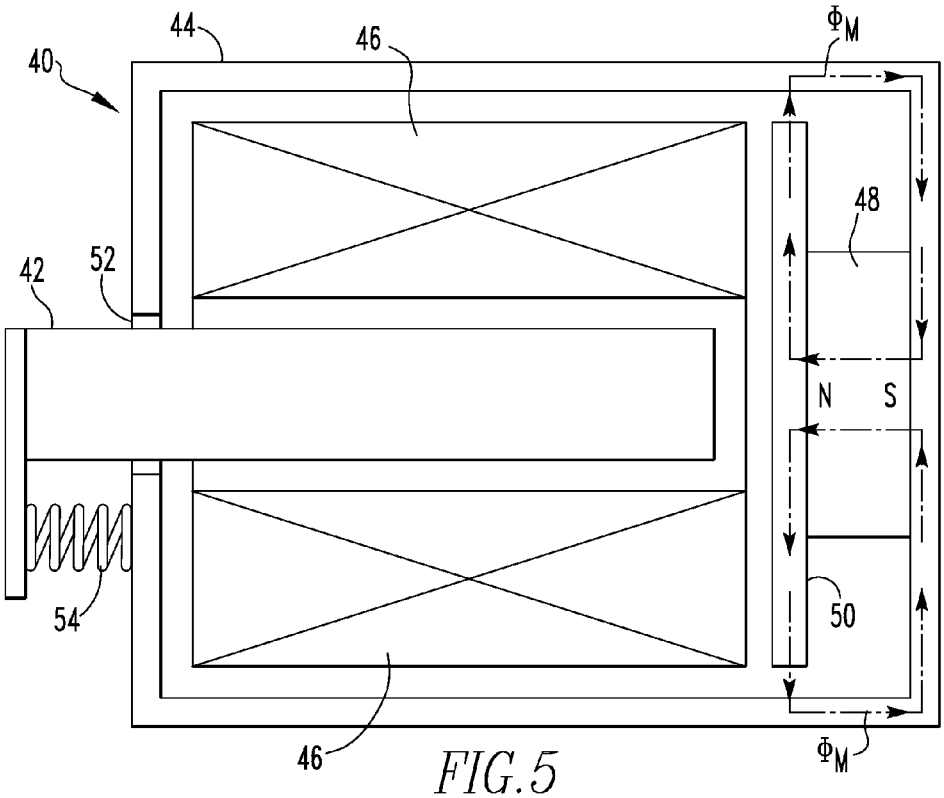
FIG. 5 is a view of the electromagnetic assembly of FIG. 3 in a first condition.

FIG. 5 illustrates the electromagnetic assembly 40 in a first condition. In the first condition, no current flows through the coil 46 and the armature 42 is in the first position where it is separated from the platform 50. In the first condition, the combined magnetic flux forces and spring bias force maintain the armature 42 in the first position. In more detail, the coil 46 does not cause any magnetic flux in the first condition because there is no current flowing through it. The permanent magnet magnetic flux $\Phi_M$ loops through the platform 50, through the outer walls of the housing 44 and back through the permanent magnet 48, as is illustrated in FIG. 5. The permanent magnet magnetic flux $\Phi_M$ does not flow through the armature 42 and therefore does not apply force to the armature 42. The spring 54 biases the armature 42 in a direction away from the permanent magnet 48 and maintains the armature 42 in the first position.

Figure 6:
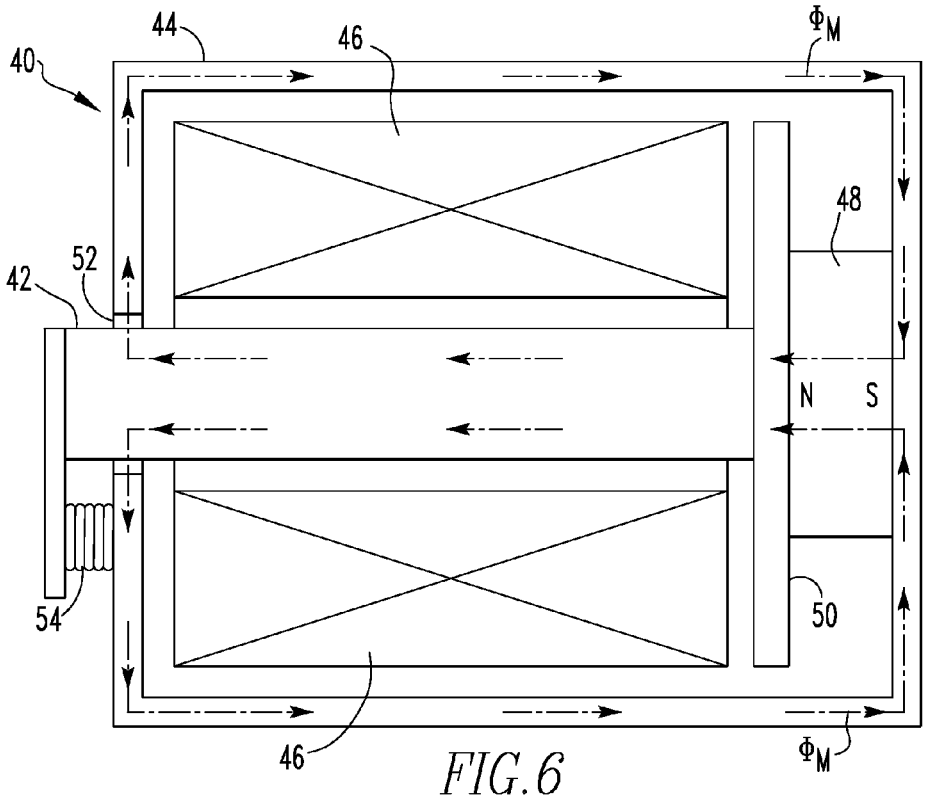
FIG. 6 is a view of the electromagnetic assembly of FIG. 3 in a second condition.

FIG. 6 illustrates the electromagnetic assembly 40 in a second condition. In the second condition, no current flows through the coil 46 and the armature 42 is in the second position where it contacts the platform 50. In the second condition, the combined magnetic flux forces overcome the spring bias force and maintain the armature 42 in the second position. In more detail, the coil 46 does not cause any magnetic flux in the second condition because there is no current flowing through it. The permanent magnet magnetic flux $\Phi_M$ loops through the armature 42 and into the outer walls of the housing 44 at the opening 52. The permanent magnet magnetic flux $\Phi_M$ then loops back into the permanent magnet 48, as is illustrated by the arrows in FIG. 6. The permanent magnet magnetic flux $\Phi_M$ caused by the permanent magnet 48 applies a force on the armature 42 in a direction towards the permanent magnet 48. The spring 54 biases the armature 42 in a direction away from the permanent magnet 48. However, the force caused by the permanent magnet magnetic flux $\Phi_M$ is stronger than the opposing force applied by the spring 54 and therefore the armature 42 is held in the second position by the combined magnetic flux forces and spring 54 bias force.

The electromagnetic assembly 40 has a bi-stable characteristic. That is, when no current is flowing through the coil 46, the armature 42 can be stably maintained in the first position, as shown in FIG. 5, or in the second position, as shown in FIG. 6.

Figure 7:
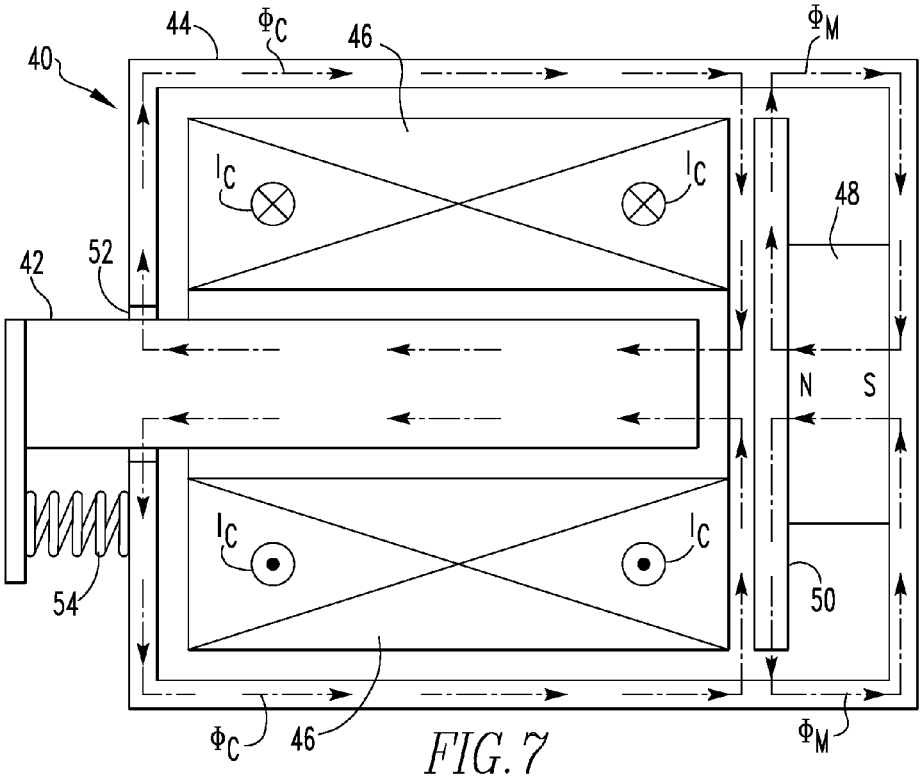
FIG. 7 is a view of the electromagnetic assembly of FIG. 3 in a third condition.

FIG. 7 illustrates the electromagnetic assembly 40 in a third condition. In the third condition, the armature 42 is initially in the first position separated from the platform 50 and current $I_C$ is flowing through the coil 46 in a first direction. In the third condition, the permanent magnet magnetic flux $\Phi_M$ loops through the platform 50 to the outer walls of the housing 44 and back through the permanent magnet 48. The permanent magnet magnetic flux $\Phi_M$ does not apply any force to the armature 42. On the other hand, the coil magnetic flux $\Phi_C$ provides a force on the armature 42 in a direction toward the permanent magnet 48. In more detail, the coil magnetic flux $\Phi_C$ loops through the armature 42 and into the outer walls of the housing 44 at the opening 52. It continues to loop into the platform 50 and back into the armature 42. The spring 54 biases the armature 42 in a direction away from the permanent magnet 48. However, the force caused by the spring 54 in the direction away from the permanent magnet 48 is less than the force caused by the coil magnetic flux $\Phi_C$ in the direction toward the permanent magnet 48. Thus, when the electromagnetic assembly 40 is in the third condition, where the armature 42 is in the first position and current flows through the coil 46 in the first direction, the armature 42 will move to the second position. If the current continues to flow or not through the coil 46 in the first direction while the armature 42 is in the second position, the armature 42 will maintain the second position.

Figure 8:
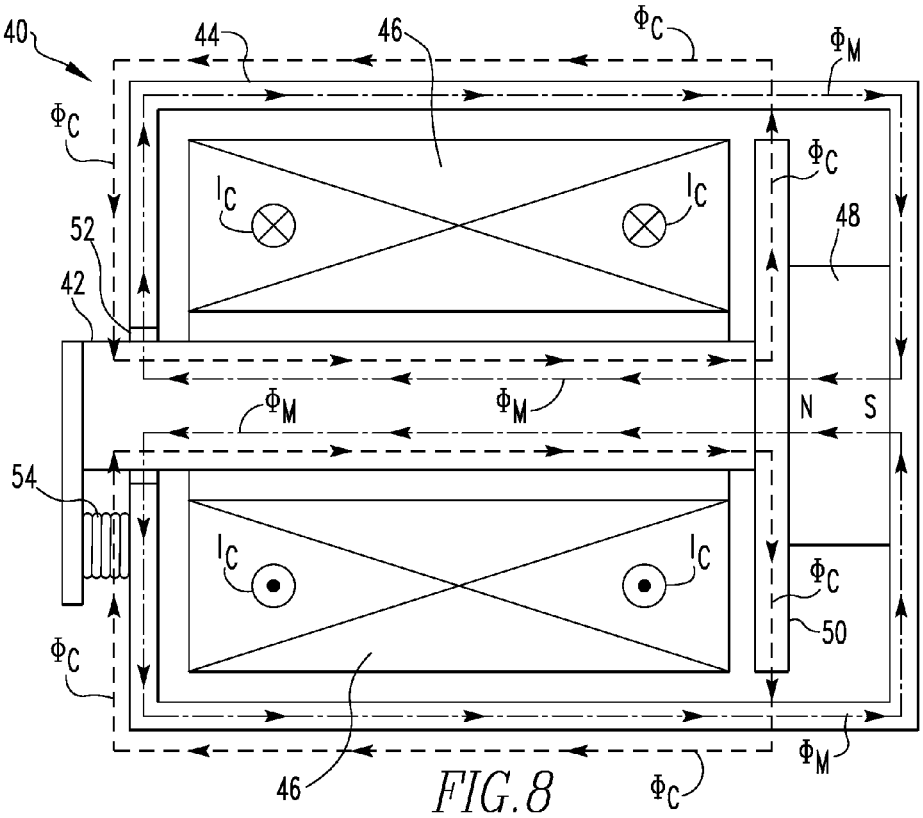
FIG. 8 is a view of the electromagnetic assembly of FIG. 3 in a fourth condition.

FIG. 8 illustrates the electromagnetic assembly 40 in a fourth condition. In the fourth condition, the armature 42 is initially in the second position where it contacts the platform 50 and current $I_C$ flows through the coil 46 in a second direction opposite of the first direction. In the fourth condition, the permanent magnet magnetic flux $\Phi_M$ loops through the armature 42 and into the outer walls of the housing 44 at the opening. The permanent magnet magnetic flux $\Phi_M$ continues to loop through the outer walls of the housing 44 and back into the permanent magnet 48. The coil magnetic flux $\Phi_C$ loops down through the armature 42 and into the platform 50. The coil magnetic flux $\Phi_C$ continues to loop through the platform 50 and into the outer walls of the housing 44. The coil magnetic flux $\Phi_C$ then loops back into the armature 42 and the opening 52. The permanent magnet magnetic flux $\Phi_M$ and the coil magnetic flux $\Phi_C$ oppose each other in the armature 42 so their combined magnetic flux is cancelled resulting in no net magnetic force on the armature 42. The spring 54 biases the armature 42 in a direction away from the permanent magnet 48. The force provided by the spring 54 is greater than the magnetic force and causes the armature 42 to move to the first position. In the fourth condition, the coil magnetic flux $\Phi_C$ increases (in opposition to the permanent magnet magnetic flux $\Phi_M$) when the coil current increases. As the coil magnetic flux $\Phi_C$ approaches the value of the permanent magnet magnetic flux $\Phi_M$, the net flux approaches zero, and the magnetic force on the armature 42 becomes smaller than the spring 54 force, and the armature 42 moves to the first position. As the coil magnetic flux $\Phi_C$ becomes larger than the value of the permanent magnet magnetic flux $\Phi_M$, the net flux increases, and the magnetic force on the armature 42 increases. The coil magnetic flux $\Phi_C$ and the magnetic force can be limited by designing the platform 50 to saturate, or by limiting the coil current. Thus, when the electromagnetic assembly 40 is in the fourth condition, where the armature 42 is in the second position and current $I_C$ flows through the coil 46 in the second direction, the armature 42 will move to the first position. If the current continues to flow through the coil 46 in the second direction while the armature 42 is in the first position, the armature 42 will remain in the first position.

Figure 13:
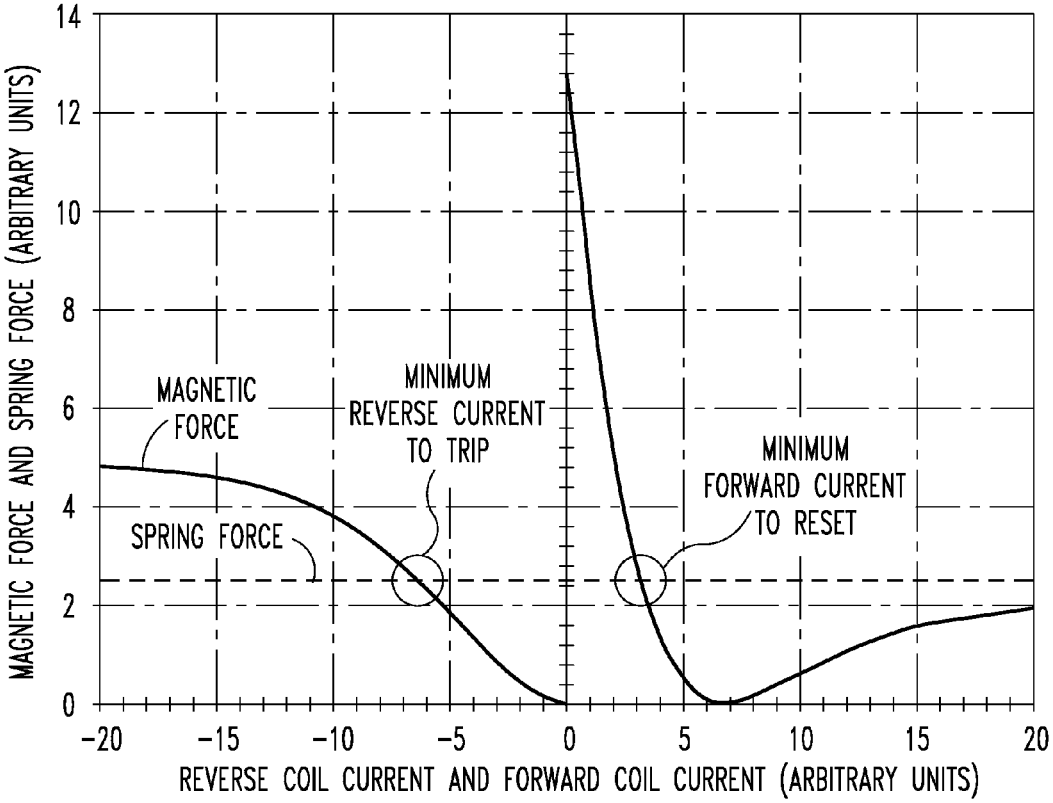
FIG. 13 is a diagram of magnetic and spring forces vs. current in an electromagnetic assembly in an example embodiment of the disclosed concept.

FIG. 13 illustrates the characteristics of the magnetic force on the armature 42 (i.e., the net magnetic forces on the armature 42 caused by the permanent magnet magnetic flux $\Phi_M$ and the coil magnetic flux $\Phi_C$) as a function of the coil current for the third and fourth conditions in the electromagnetic assembly 40. The left side of FIG. 13 illustrates the third condition in which the armature 42 is in the first position and the coil current is in the first direction. The magnetic force increases as the coil current increases. When the armature magnetic force increases to a value greater than the spring force, the armature 42 will move to the second position. The right side of FIG. 13 illustrates the fourth condition in which the armature 42 is in the second position and the coil current is in the second direction opposite of the first direction. The magnetic force decreases as the coil current increases. When the armature magnetic force decreases to a value smaller than the spring force, the armature will move to the first position.

Referring back to the example circuit interrupter 10' shown in FIGS. 3 and 4, moving the armature 42 from the first position to the second position causes the separable contacts 16 to trip open. The example circuit interrupter 10' is arranged such that current flowing in a direction from the first terminal 12 to the second terminal 14 will flow through the coil 46 in the second direction, and that current flowing in a direction from the second terminal 14 to the first terminal 12 will flow through the coil 46 in the first direction. That is, current flowing in a direction from the first terminal 12 to the second terminal 14 will cause the armature 42 to move to or remain in the first position and the separable contacts 16 will not trip open. Current flowing in a direction from the second terminal 14 to the first terminal 12 will cause the armature 42 to move to the second position and cause the separable contacts 16 to trip open. Thus, the electromagnetic assembly 40 provides the circuit interrupter 10' with current direction sensitivity with respect to tripping open the separable contacts 16.

Figure 9:
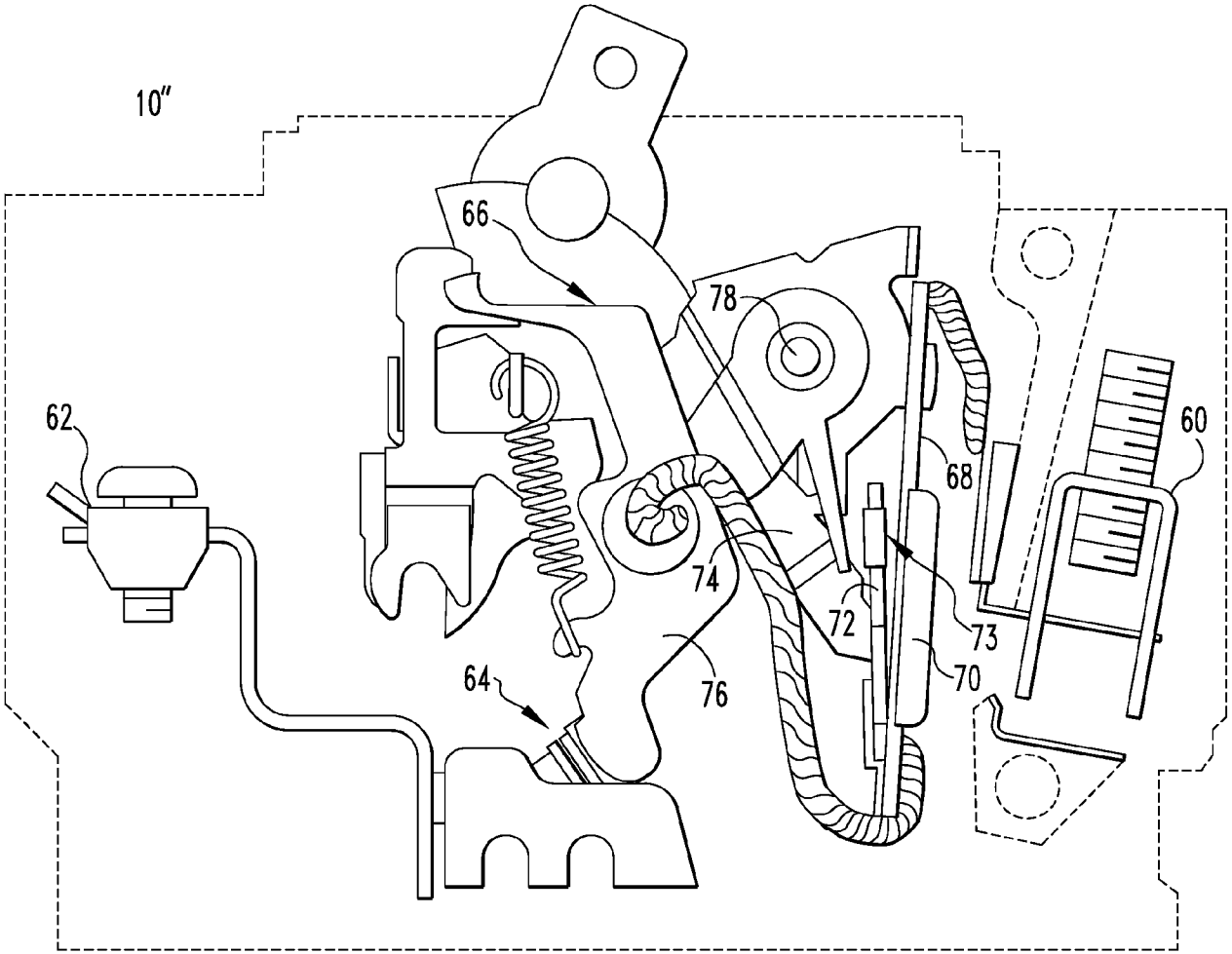
FIG. 9 is an elevation view of a circuit interrupter in accordance with another example embodiment of the disclosed concept.

Referring now to FIG. 9 another example circuit interrupter 10" includes a first terminal 60, a second terminal 62, separable contacts 64, an operating mechanism 66, a conductor 68, a flux concentrator 70 mounted to the conductor 68, an armature 72, and a magnet 73 attached to the armature 72. The operating mechanism 66 includes a cradle 74 and a moving contact arm 76. The cradle 74 is normally latched to the armature 72. When the cradle 74 is released from the armature 72 by, for example, moving the armature 72 away from the cradle 74, the cradle 72 moves downward which in turn causes the moving contact arm 76 to rotate. One of the separable contacts 64 is disposed on the moving contact arm 76 and the other of the separable contacts 64 is stationary so that the rotation of the moving contact arm 76 causes the separable contacts 64 to trip open.

The circuit interrupter 10" further includes a trip cam 78 that is structured to rotate when the cradle 74 is released from the armature 72. In the example circuit interrupter 10", each pole (only one is shown) has its own corresponding terminals 60,62, separable contacts 64, operating mechanism 66, conductor 68, flux concentrator 70, and armature 72, but the trip cam 78 is shared between all the poles. When the trip cam 78 rotates, it contacts the armature 72 corresponding to each pole causing the cradle 74 corresponding to each pole to be released and the separable contacts 64 corresponding to each pole to trip open. In other words, when a trip is initiated in one of the poles of the circuit interrupter 10", the trip cam 78 causes a trip to be initiated in all of the poles of the circuit interrupter 10".

Figure 10:
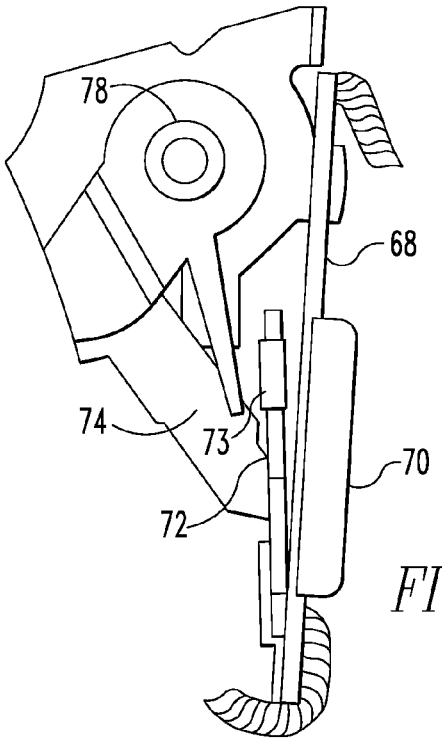
FIG. 10 is a detail view of a portion of the circuit interrupter of FIG. 9 with a latched cradle.
Figure 11:
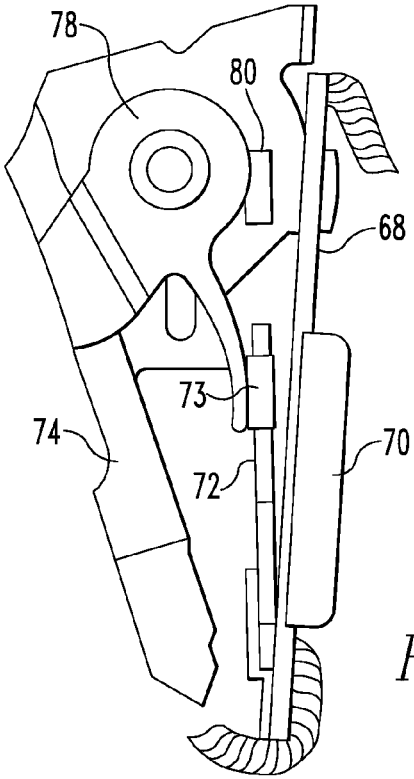
FIG. 11 is a detail view of a portion of the circuit interrupter of FIG. 9 with an unlatched cradle.

Operations of the conductor 68, the flux concentrator 70, the armature 72, and the magnet 73 will be described in more detail hereinafter with respect to FIGS. 10 and 11. In FIG. 10, the cradle 74 is latched to the armature 72. Current flowing between the first terminal 60 and the second terminal 62 (see FIG. 9) flows through the conductor 68 which causes a magnetic field around the conductor 68. The flux concentrator 70 aligns the magnetic field around the conductor 68 in a direction of the armature 72. Depending on the direction of the current flowing through the conductor 68, the magnetic field will cause the magnet 73 to be pulled toward the conductor 68 or repelled away from the conductor 68. In the example circuit interrupter 10", current flowing in a direction from the first terminal 60 to the second terminal 62 (see FIG. 9) will cause the magnet 73 to be repelled away from the conductor 68 and current flowing in a direction from the second terminal 62 to the first terminal 60 will cause the magnet to be pulled toward the conductor 68. However, it will be appreciated by those having ordinary skill in the art that the orientation of the magnet 73 may be switched to cause the magnet 73 to be pulled toward the conductor 68 when current flows in the direction from the first terminal 60 to the second terminal 62. When the magnet 73 is pulled toward the conductor 68, the armature 72 is also pulled toward the conductor 68 causing the cradle 74 to release from the armature 72, as is shown in FIG. 11, and the separable contacts 64 to trip open. This type of trip is referred to as an instantaneous trip.

In some example embodiments of the disclosed concept, the conductor 68 has a bimetal characteristic. The bimetal characteristic causes the conductor 68 to bend when it changes in temperature. Excessive current flowing through the conductor 68 can cause the conductor 68 to heat up and bend. The conductor 68 bending can initiate a trip by bending far enough toward the armature 72 that it pushes the cradle 74 and causes it to release from the armature 72. This type of trip is often referred to as a thermal trip. In the example circuit interrupter 10", the instantaneous trip is dependent on the direction of the current flowing through it, but the trip initiated by the bending of the conductor 68 is not.

In some embodiments of the disclosed concept, a second magnet 80 is disposed on the trip cam 78. The second magnet 80 provides a magnetic force that pulls the conductor 68 toward the armature 72. The second magnet 80 can be used to adjust the current level at which the trip occurs.

Figure 12:
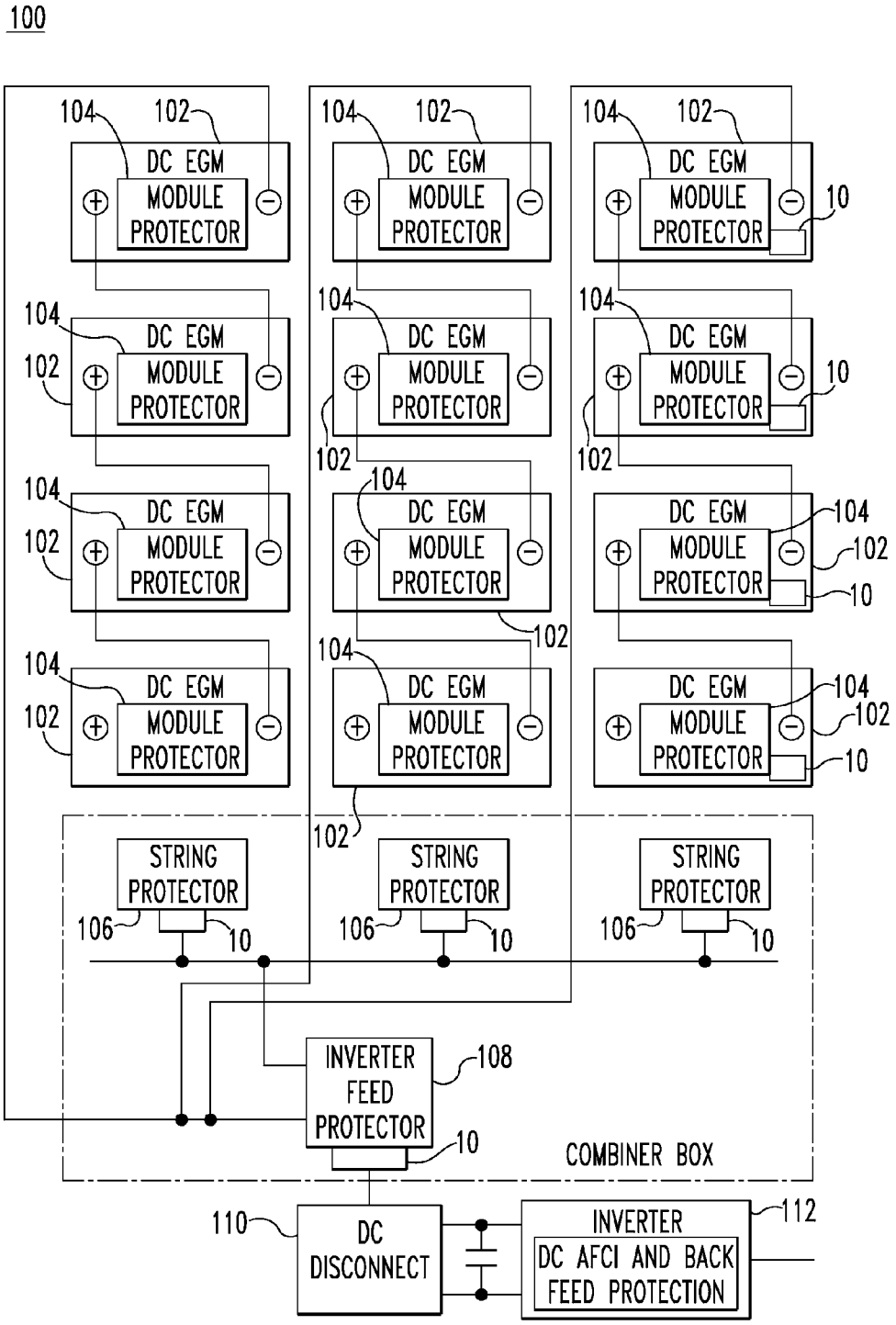
FIG. 12 is a circuit diagram in partial block form of a photovoltaic system in accordance with another example embodiment of the disclosed concept.

FIG. 12 illustrates a photovoltaic (PV) system 100 employing the example circuit interrupter 10 of FIGS. 1 and 2. However, it will be appreciated that the photovoltaic system 100 may also employ example circuit interrupters 10' or 10"

without departing from the scope of the disclosed concept. The PV system 100 includes a number of strings that each include a number of direct current electrical generating modules (DC EGMs) 102 electrically connected in series. The DC EGMs 102 are each configured to generate direct current power though, for example, photovoltaic cells. Each DC EGM 102 includes a module protector 104. Each module protector 104 is configured to break the circuit in the string at the module protector 104 in the event of a fault. Each string also includes a string protector 106. Each string protector 106 is structured to disconnect its corresponding string in the event of a fault.

The PV system 100 further includes an inverter feed protector 108 configured to disconnect all the strings in the event of a fault. The PV system 100 also includes a direct current disconnect 110 and an inverter 112. The DC disconnect 110 is structured to disconnect the strings from the inverter 110 and the inverter 112 is structured to receive direct current power from the strings and to convert it to alternating current power.

In normal operation of the PV system 100, current flows in one direction through the strings, string protectors 106 and inverter feed protector 108. A change in the direction of the current flow is indicative of a fault in the photovoltaic system 100 or an undesirable condition such as current backflow to a shaded string. Thus, the circuit interrupter 10 which is sensitive to the direction of current flowing through it is particularly suitable for use in the photovoltaic system 100.

While the circuit interrupter 10 is disclosed as part of the DC EGMs 102, string protectors 106, and inverter feed protectors 108, it is contemplated that any of the disclosed circuit interrupters 10, 10', and 10" may be employed in any one or any combination of the DC EGMs 102, the string protectors 106, and the inverter feed protector 108 without departing from the scope of the disclosed concept. A common reset switch (not shown) may also be employed without departing from the scope of the disclosed concept.

Although PV system 100 is disclosed, it will be appreciated by those having ordinary skill in the art that the disclosed concept is also applicable to a wide range of DC applications, including for example and without limitation, relatively higher DC voltage circuits, such as wind power, hybrid vehicles, electric vehicles, marine systems and aircraft.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A circuit interrupter comprising:

a first terminal;

a second terminal;

separable contacts moveable between a closed position and an open position;

an operating mechanism configured to open said separable contacts;

an electromagnetic assembly cooperating with said operating mechanism, said electromagnetic assembly comprising:

an armature coupled with said operating mechanism, said armature being movable between a first position and a second position that causes the operating mechanism to trip open the separable contacts;

a coil electrically connected between the first terminal and the second terminal cooperating with said armature to move said armature between the first position and the second position based on a current flowing through the coil;

a magnet;

a platform disposed between the magnet and the armature;

a spring structured to bias the armature toward the first position; and a housing surrounding the coil, the magnet, the platform, and a portion of the armature, said housing including an opening structured to allow the armature to pass through it, wherein a current flowing through the circuit interrupter flows in a direction from the first terminal toward the second terminal, the current flows in a first direction through the coil and causes the armature to move to or maintain the first position; and wherein when the current flowing through the circuit interrupter flows in a direction from the second terminal toward the first terminal, the current flows in a second direction through the coil and causes the armature to move to or maintain the second position.

2. The circuit interrupter of claim 1, wherein when the armature is in the first position and no current flows through the coil, the spring bias maintains the armature in the first position.

3. The circuit interrupter of claim 1, wherein when the armature is in the second position and no current flows through the coil, magnetic flux caused by the magnet maintains the armature in the second position.

4. The circuit interrupter of claim 1, wherein when the armature is in the first position and the current flows in the second direction through the coil, magnetic flux caused by the magnet and the current flowing through the coil moves the armature to the second position.

5. The circuit interrupter of claim 1, wherein when the armature is in the second position and the current flows in the first direction through the coil, magnetic flux caused by the magnet counteracts magnetic flux caused by the current flowing though the coil and the spring bias moves the armature to the first position.

6. The circuit interrupter of claim 1, wherein the operating mechanism includes a latch; and wherein releasing said latch causes the operating mechanism to trip open the separable contacts.

7. The circuit interrupter of claim 1, wherein when the armature is in the first position, the armature is separated from the platform; and wherein when the armature is in the second position, the armature contacts the platform.

8. The circuit interrupter of claim 1, wherein when the armature is in the first position and no current flows through the coil, the electromagnetic assembly is structured to maintain the armature in the first position; and wherein when the armature is in the second position and no current flows through the coil, the electromagnetic assembly is structured to maintain the armature in the second position.

9. The circuit interrupter of claim 1, wherein the circuit interrupter is employed in a photovoltaic system.

10. The circuit interrupter of claim 1, further comprising:

an electrical reset mechanism electrically connected between the first terminal and the electromagnetic assembly, said electrical reset mechanism including a diode oriented to permit current to flow in a direction from the first terminal to the electromagnetic assembly and a switch structured to allow current to flow from the first terminal to the electromagnetic mechanism via the electrical reset mechanism when the switch is closed.

11. The circuit interrupter of claim 10, wherein the electrical reset mechanism is structured to receive power from a secondary power source to provide sufficient current to the electromagnetic assembly to reset the circuit interrupter.

* * * * *